US012280915B2

(12) United States Patent
Wince et al.

(10) Patent No.: US 12,280,915 B2
(45) Date of Patent: Apr. 22, 2025

(54) KNITTED NET CARRIER

(71) Applicant: Flavorseal LLC, Avon, OH (US)

(72) Inventors: David Wince, Avon, OH (US); Eric Aites, Avon, OH (US)

(73) Assignee: FAVORSEAL LLC, Avon, OH (US)

( * ) Notice: Subject to any disclaimer, the term of this patent is extended or adjusted under 35 U.S.C. 154(b) by 110 days.

(21) Appl. No.: 17/969,998

(22) Filed: Oct. 20, 2022

(65) Prior Publication Data

US 2023/0118716 A1 Apr. 20, 2023

Related U.S. Application Data

(60) Provisional application No. 63/257,633, filed on Oct. 20, 2021.

(51) Int. Cl.
*D04B 21/12* (2006.01)
*B65D 30/00* (2006.01)

(52) U.S. Cl.
CPC ..... *B65D 29/00* (2013.01); *D04B 21/12* (2013.01); *D10B 2331/04* (2013.01); *D10B 2401/063* (2013.01); *D10B 2505/10* (2013.01)

(58) Field of Classification Search
CPC .... B65D 29/00; D04B 21/12; D10B 2331/04; D10B 2401/063; D10B 2505/10
USPC ..... 383/117
See application file for complete search history.

(56) References Cited

U.S. PATENT DOCUMENTS 5,031,759 A * 7/1991 Ogilvie ..... D04B 1/22 383/117
5,223,198 A * 6/1993 Frankfort ..... D01D 5/082 264/235.6
5,638,703 A * 6/1997 Callaway ..... D04B 21/20 66/195
5,845,994 A * 12/1998 Rice ..... A45C 1/04 383/117
6,305,876 B1 * 10/2001 Yoshino ..... E02B 17/0017 428/36.1
7,883,399 B2 2/2011 Tallberg et al.
8,226,457 B2 7/2012 Hihnala et al.
2006/0185343 A1 * 8/2006 Coombs ..... D02G 3/38 57/210
2011/0085749 A1 * 4/2011 Frei ..... B65B 25/048 383/117
2013/0090032 A1 * 4/2013 Kim ..... D03D 1/0005 428/401
2013/0187367 A1 * 7/2013 Kim ..... D06N 3/045 28/165
2015/0052857 A1 * 2/2015 Hefner ..... B31B 70/00 383/117

(Continued)

FOREIGN PATENT DOCUMENTS

EP 1231311 A1 8/2002
EP 3178327 A1 6/2017

(Continued)

*Primary Examiner* — Peter N Helvey
(74) *Attorney, Agent, or Firm* — Troutman Pepper Locke LLP

(57) ABSTRACT

A knitted net carrier includes a plurality of strands of high tenacity polyester yarn knitted together in the form of a pattern. The netting may be substantially in the shape of a tube having a length, a first end, and a second end. The first end and the second end may be fastened shut.

16 Claims, 6 Drawing Sheets

(56) References Cited

U.S. PATENT DOCUMENTS

| | | | | |
|---|---|---|---|---|
| 2016/0073592 | A1* | 3/2016 | Toye ..... | A01G 13/0206<br>47/31 |
| 2017/0203880 | A1 | 7/2017 | Amigo | |

FOREIGN PATENT DOCUMENTS

| | | | |
|---|---|---|---|
| GB | 2582152 | A | 9/2020 |
| WO | 2005110104 | A1 | 11/2005 |

* cited by examiner

KNITTED NET CARRIER

CROSS-REFERENCE TO RELATED APPLICATIONS

This application claims the benefit of U.S. Provisional Patent Application No. 63/257,633 titled Knitted Net Carrier filed Oct. 20, 2021, which is hereby incorporated by reference herein in its entirety.

TECHNICAL FIELD

The present invention relates generally to a carrier, and, more particularly, a shiny knitted net carrier for food products.

BACKGROUND

In the food industry, it is desirable to have food packaging that is both shiny and netted. The shiny aspect is for marketing purposes, and the netting serves as a means for carrying the food product. Food products like chickens and turkeys are often wrapped in a shiny metalized film and a netting. Supply pressures have decreased the availability of resins used in making conventional food packaging; therefore, techniques for making alternative food packaging is needed. Further, automation is desired in manufacturing to save on labor costs because it is difficult to get labor in the workplace.

An ideal solution to this problem would be to replace or eliminate the shiny metalized film and decrease the labor required, likely through automation, of a carrier for food products. Further, an ideal solution would maintain a netting used to carry the product, not have additional components, and be able to be manufactured with existing equipment.

SUMMARY

Embodiments of the present invention address and overcome one or more of the above shortcomings and drawbacks, by providing methods and apparatuses related to a knitted netting for making a knitted net carrier.

According to some embodiments, a knitted net carrier includes a plurality of strands of high tenacity polyester yarn knitted together in the form of a pattern. The netting may be substantially in the shape of a tube having a length, a first end, and a second end. The first end and the second end may be fastened shut.

Various enhancements, refinements, and other modifications can be made to the aforementioned knitted net carrier in different embodiments. For example, in some embodiments, the pattern of the netting is formed with one or more goblet shapes. In one embodiment, the goblet shapes are formed using twenty stitches.

According to another aspect of the present invention, a knitted netting for making a knitted net carrier includes a plurality of strands of high tenacity polyester yarn knitted together in the form of a pattern. The netting may be substantially in the shape of a tube having a length, a first end, and a second end.

Various enhancements, refinements, and other modifications can be made to the aforementioned knitted netting in different embodiments. For example, with respect to the high tenacity polyester yarn, in some embodiments, the high tenacity polyester yarn has a linear density of 500. In some embodiments, the high tenacity polyester yarn has a tenacity of greater than 9.0 grams per density. In some embodiments, the high tenacity polyester yarn has a HAS of 6.5 at 15 min at 190° C. In some embodiments, the high tenacity polyester yarn has an oil content of 0.55%.

Further, the netting's shininess may be affected by the pattern's size and the number of threads used to knit the netting. In some embodiments, the pattern of the netting is formed with one or more goblet shapes. In one embodiment, the goblet shapes are formed using twenty stitches. In some embodiments, the pattern of the netting is formed with one or more zig zag shapes. In one embodiment, the zig zag shapes are formed using eight stitches. In some embodiments, the pattern of the netting is formed with one or more diamond shapes. In one embodiment, the diamond shapes are formed using six stitches. In one embodiment, the diamond shapes are formed using eight stitches. In some embodiments, the pattern of the netting is formed with one or more hex shapes. In one embodiment, the hex shapes are formed using eight stitches.

According to another aspect of the present invention, a method of forming a knitted netting includes knitting a plurality of strands of high tenacity polyester yarn to form a netting have a pattern. The netting may form a tube having a length, a first end, and a second end.

Additional features and advantages of the invention will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings embodiments that are presently preferred, it being understood, however, that the invention is not limited to the specific instrumentalities disclosed. Included in the drawings are the following Figures.

DETAILED DESCRIPTION

The present disclosure describes a shiny knitted net carrier and methods of making the same. The knitted net gets its shiny qualities from the high tenacity polyester yarn is it is knitted from. Because the netting itself is shiny, no shiny metalized film is required. Instead of a shiny metalized film, a non-shiny colored or clear film can be used to wrap the product before it is wrapped in a netting. The shiny knitted net carrier can be used to carry products, including food products like turkeys and chickens.

High Tenacity Polyester Yarn

Various embodiments of the knitted carriers described herein are constructed from a high tenacity polyester yarn. Tenacity is defined as force divided by linear density. In one embodiment, a polymer yarn can be defined as "high tenacity" if it has a tenacity >9.0 grams/linear density. In one embodiment, the yarn may have the specifications set forth in TABLE 1. High tenacity polyester yarn is generally used in car seats, air bags, and other such applications and is not presently being used in food packaging. However, as described herein, high tenacity polyester yarn has many advantages compared to materials currently used in the technical field for food packaging and thus provides significant benefits as compared to presently utilized food packaging materials. The yarn can also have a variety of different colors, including white or red as shown in FIGS. 1B-1H and FIG. 3A. In various embodiments, the high tenacity polymer yarns described herein could include the materials (along with their associated physical properties) provided below in TABLE 2.

TABLE 1

| | |
|---|---|
| Linear Density | 500 |
| Tenacity | >9.0 gr/density |
| Elongation at Break | 13.0 (+/−2.0) |
| HAS (15 min 190° C.) | 6.5 (+/−1.0) |
| Oil Content | 0.55% |

TABLE 2

| Yarn Type | Fil Count | Denier Size | Breaking Strength (lbs) | Tenacity (g/d) | Elongation at Break | Hot Air Shrinkage |
|---|---|---|---|---|---|---|
| HT101 | 192 | 1012 +/− 16 | 20.6 | 9.2 | 14.0 +/− 1.5 | 7.5 +/− 1.5 |
| SF1 | 192 | 1018 +/− 26 | 19.7 | 9.1 | 14.0 +/− 2.0 | 7.5 +/− 1.5 |
| 855T-2 | 192 | 1012 +/− 27 | 20.2 | 9 | 13.0 +/− 2.5 | 12.5 +/− 2.5 |
| HT Poly | 192 | 1010 +/− 15 | 20.5 | 9.2 | 14.0 +/− 2.0 | 7.0 +/− 1.5 |
| HT Poly | 192 | 1000 +/− 20 | 20.2 | 9.18 | 13.5 +/− 2.0 | 6.5 +/− 1.5 |
| 1W70 | 192 | 1005 +/− 35 | 19.7 | 8.9 | 14.0 +/− 3.0 | 8.9 +/− 2.5 |
| Eastlene | 192 | 1000 +/− 20 | 20.3 | 9.2 | 14.0 +/− 2.0 | 13.0 +/− 1.5 |

Method of Making of Carrier

Figure 1A:
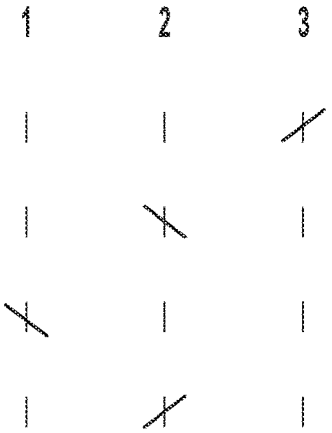
FIG. 1A is an exemplary embodiment of a knitting pattern for a four-stitch diamond pattern.
Figure 1B:
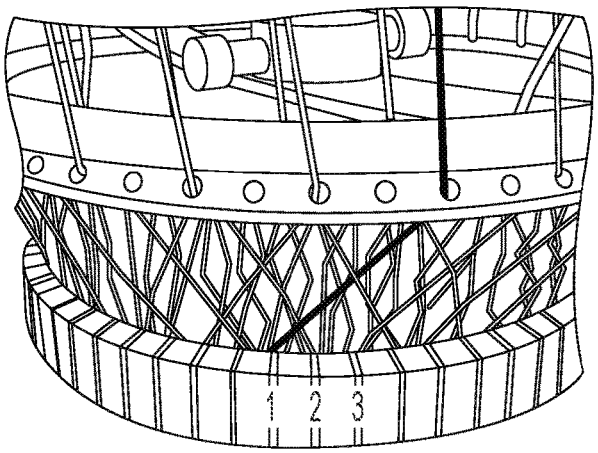
FIGS. 1B-1H show an exemplary embodiment of a method of knitting a netting.
Figure 1C:
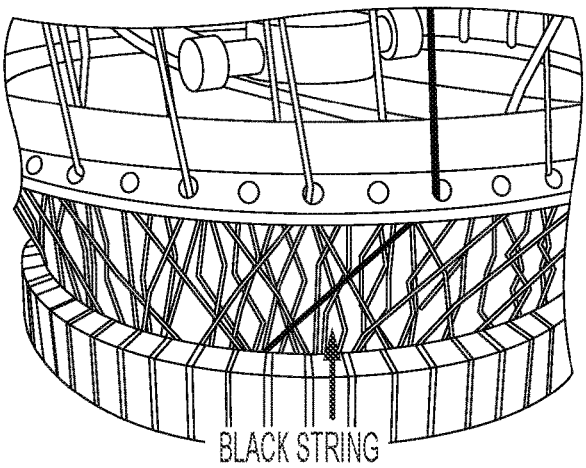
Figure 1D:
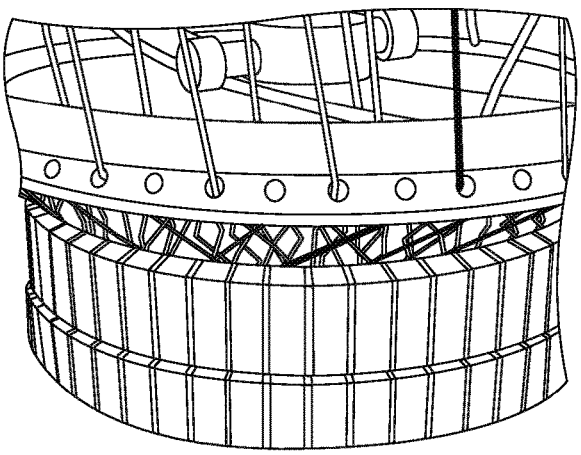
Figure 1E:
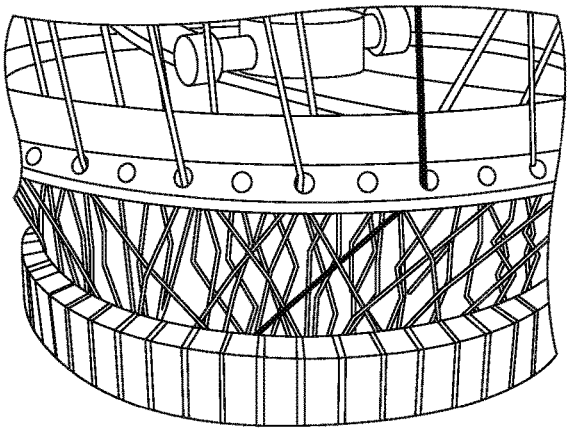
Figure 1F:
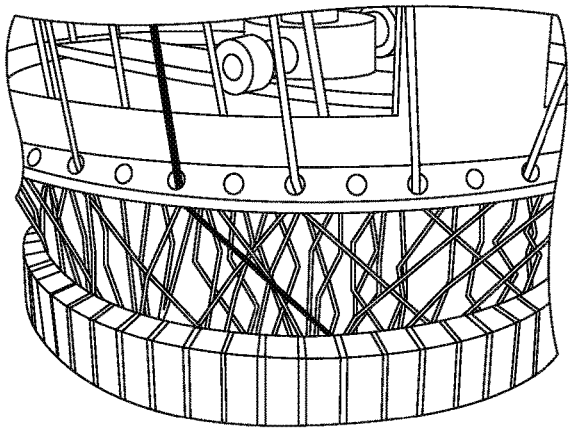
Figure 1G:
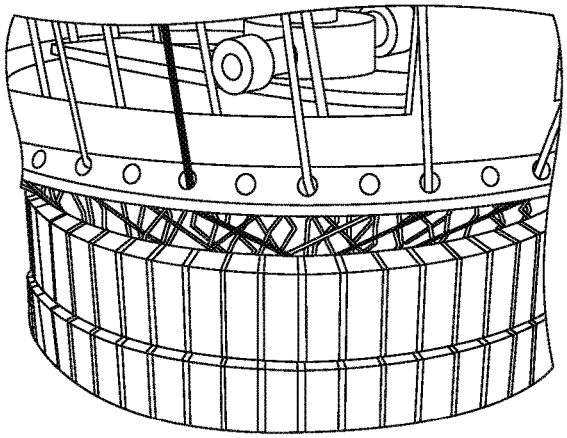
Figure 1H:
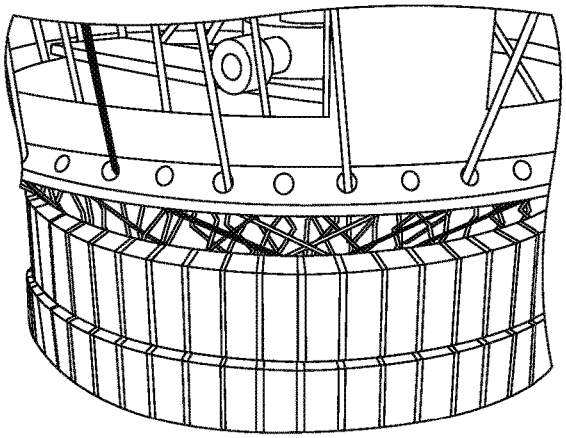
Figure 1I:
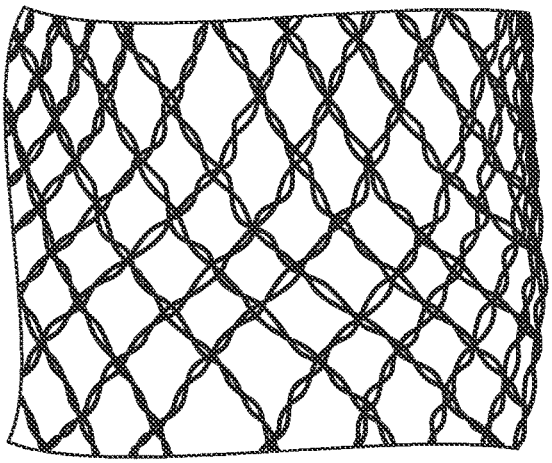
FIG. 1I is an embodiment of a knitted netting with a four-stitch diamond pattern.

The following is an embodiment of a method of knitting a knitted net carrier with high tenacity yarn. The first steps are to obtain a high tenacity polyester yarn and identify a desired yarn pattern. An embodiment of a knitting pattern for a four stitch diamond pattern is shown in FIG. 1A. In the preferred embodiment, the yarn is knitted into a carrier using the piece of machinery shown in FIG. 1B. This knitting machine will produce a tubular sleeve of netting. On the knitting machine, locate three consecutive knitting needles, as shown in FIG. 1B. Mark one of the outside strings black, as shown in FIG. 1C. This will be the string that follows the knitting pattern. Move the marked needle to the next correct needle, as indicated by the knitting pattern, and repeat until the marked string has completed the proper movements for all needles, as shown in FIGS. 1D-1H. The knitting pattern will require the string to be moved from one needle to the next. This is called a "cross-over" stitch that causes the strings to knit into each other to create a finished pattern. Upon completion, the pattern shown in the knitting pattern is produced. In this embodiment, the knitting pattern produced a netting with a four stitch diamond pattern, as shown in FIG. 1J.

Figure 2:
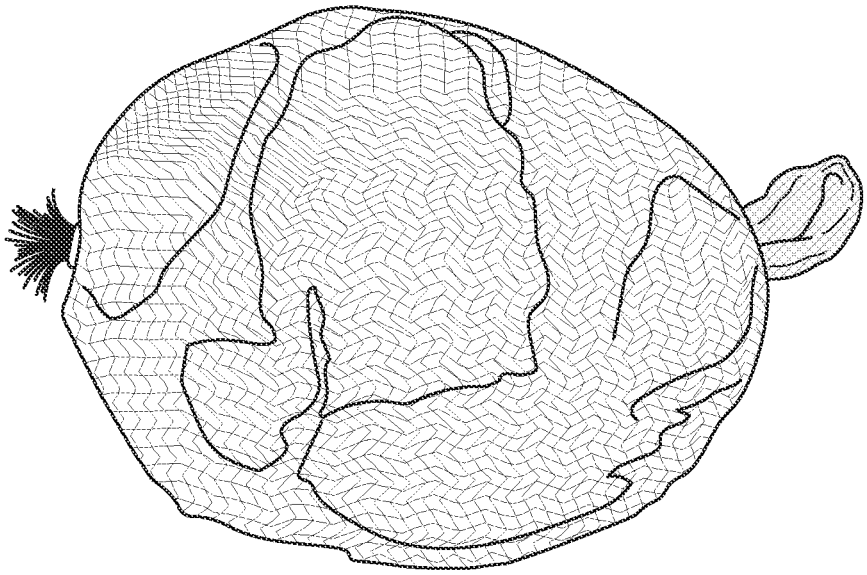
FIG. 2 is a food product in an embodiment of a knitted net carrier.

Once the netting is knitted, it can be formed into a carrier. In the embodiment discussed above, the knitting machine produces a tubular netting with a length and two open ends. A carrier can be formed by cutting a piece of netting at a desired length, clipping one of the open ends with a metal clip, inserting into the netting the product to be carried, and tying the other open end in a loop. FIG. 2 is an exemplary embodiment of a netting that was formed into a carrier. Other things may be attached to the carrier underneath the metal clip including a price tag and artwork.

In an embodiment, the completed netting is first rolled over a core.

In another embodiment, the completed netting is first bunched up on to a ruck and then on to a horn. Then, products are moved through the horn, so that there can be a continuous process of creating knitted net carriers on the products.

In another embodiment, the completed netting is put onto a mandrel and then on to the ruck. In some embodiments, the mandrel may be made of plastic or cardboard. In some embodiments, 500 ft. or less of netting is put on the mandrel.

In another embodiment, instead of using a knitting machine that will produce a tubular sleeve, the yarn may be knit to produce a planar sheet of netting. In such embodiment, the planar sheet of netting could be wrapped around a product and secured shut with a clip or a loop. Alternatively, the planar sheet of netting could be rolled and secured a tube shape, and secured shut on each end.

Knitted Patterns

The shininess of the netting comes from the shininess of the high tenacity polyester yarn and will depend on the amount of surface area of the threads of the netting. The greater the surface area of the threads of the netting, the shinier the overall netting. Therefore, the shininess of the netting can be influenced by the size of the knitted pattern and the number of stitches used. The smaller the knitted pattern, the greater the surface area of the threads, and the shinier the netting. The more stitches used, the greater the surface area of the threads, and the shinier the netting. The netting can be knitted in many different patterns.

The patterns will depend on the number of needles used to knit the netting, the number of stitches used to create one shape in the pattern, and the netting's desired stretch width. A netting's stretch width indicates how far the netting can stretch from its width at rest to its width when it is stretched to its capacity.

Figure 3A:
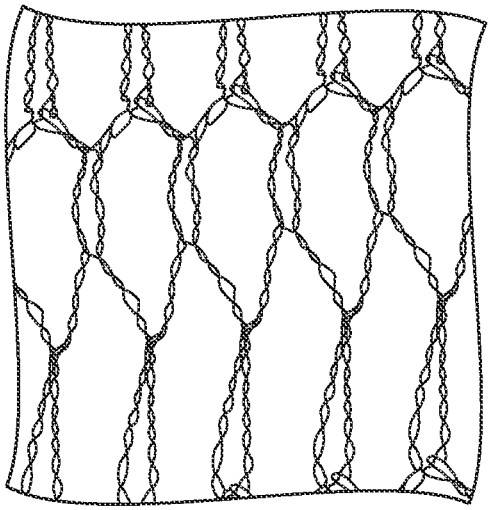
FIG. 3A is an embodiment of a knitted netting with a twenty-stitch goblet pattern.
Figure 3B:
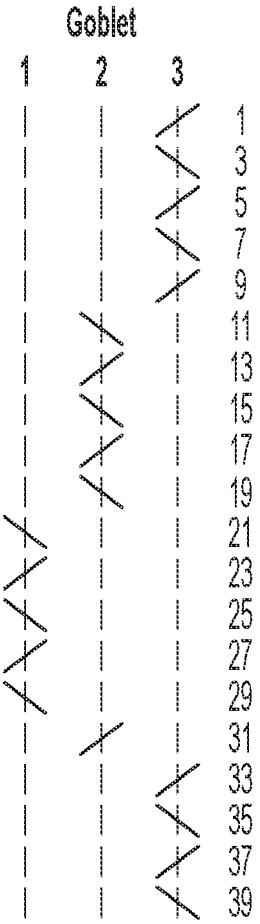
FIG. 3B is an exemplary embodiment of a knitting pattern for a twenty-stitch goblet pattern.

In one embodiment, the netting can be knitted into a "goblet" pattern, as shown in FIG. 3A. Twenty stitches are used to create one goblet shape. Sixty-four needles are used to knit this pattern. This netting has a stretch width of 17". The knitting pattern used to create the depicted goblet pattern is shown in FIG. 3B.

Figure 4A:
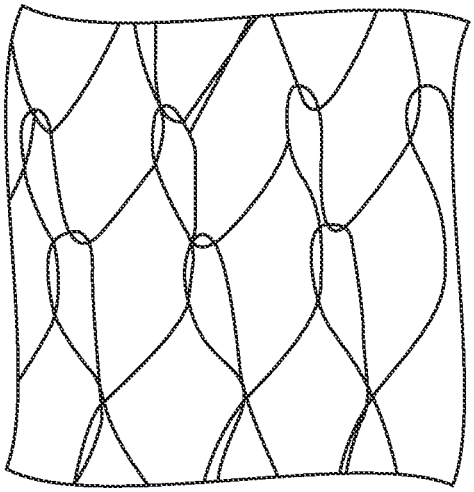
FIG. 4A is an embodiment of a knitted netting with an eight-stitch zig zag pattern.
Figure 4B:
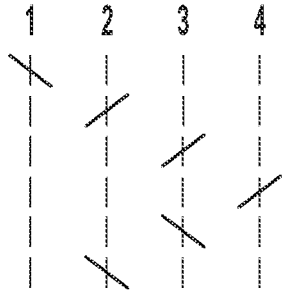
FIG. 4B is an exemplary embodiment of a knitting pattern for an eight-stitch zig zag pattern.

In one embodiment, the netting can be knitted into "zig zag, single stitch, diamond" pattern, as shown in FIG. 4A. Sixty-four needles are used to knit this pattern. Eight stitches are used to create one zig zag shape. It has a stretch width of 17". The associated knitting pattern used to create the depicted zig zag, single stitch, diamond pattern is shown in FIG. 4B.

Figure 5A:
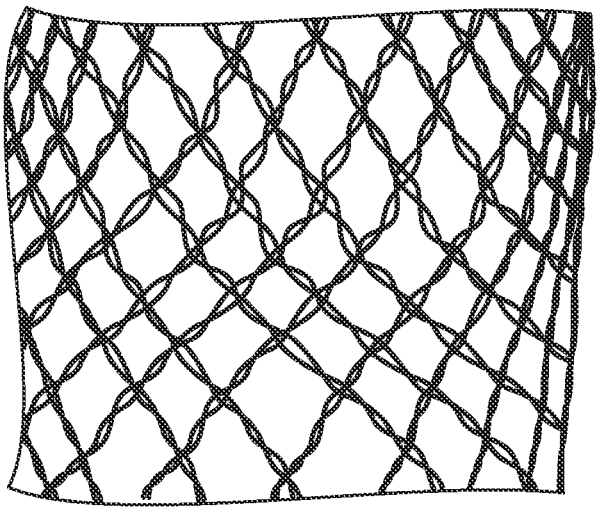
FIG. 5A is an embodiment of a knitted netting with a four-stitch diamond pattern.
Figure 5B:
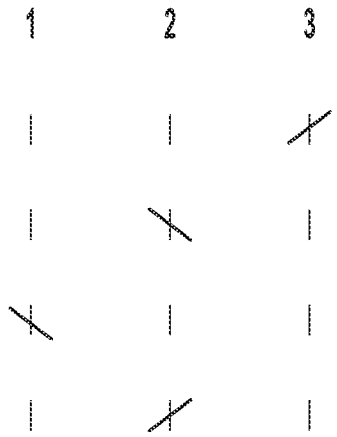
FIG. 5B is an exemplary embodiment of a knitting pattern for a four-stitch diamond pattern.
Figure 6A:
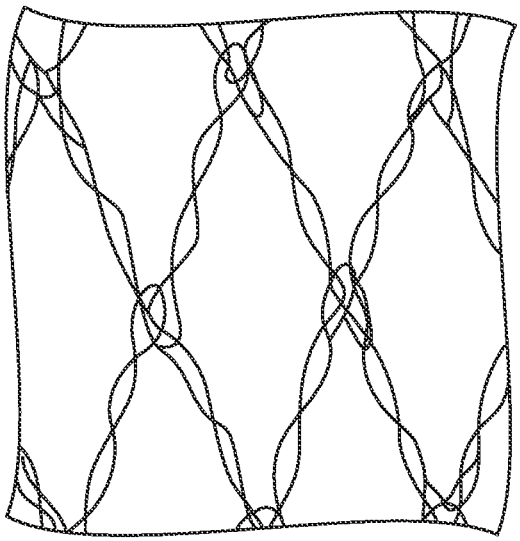
FIG. 6A is an embodiment of a knitted netting with a six-stitch diamond pattern.
Figure 7A:
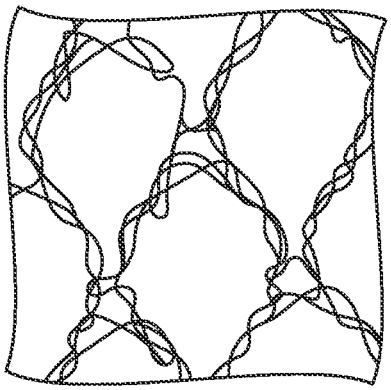
FIG. 7A is an embodiment of a knitted netting with an eight-stitch diamond pattern.

In one embodiment, the netting can be knitted into a "diamond" pattern, as shown in FIGS. 5A, 6A, and 7A. The pattern in FIG. 5A uses four stitches to create one diamond shape. The knitting pattern used to create the depicted diamond pattern is shown in FIG. 5B.

Figure 6B:
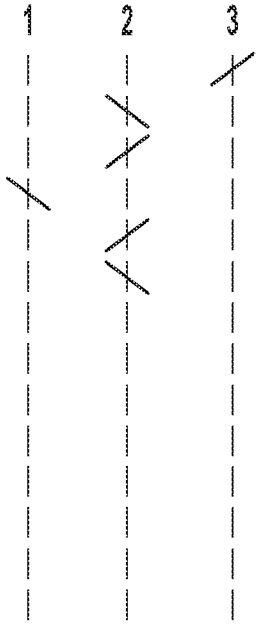
FIG. 6B is an exemplary embodiment of a knitting pattern for a six-stitch diamond pattern.

The pattern is 6A is knitted using 96 needles. This pattern requires six stitches to create one diamond shape. The knitting pattern used to create the depicted diamond pattern is shown in FIG. 6B.

Figure 7B:
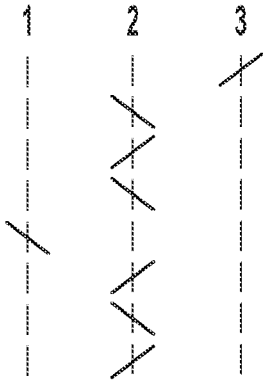
FIG. 7B is an exemplary embodiment of a knitting pattern for an eight-stitch diamond pattern.

The pattern in 7A uses eight stitches to create one diamond shape. It is knitted using 96 needles and has a stretch width of 17". The knitting pattern used to create the depicted diamond pattern is shown in FIG. 7B.

Figure 8A:
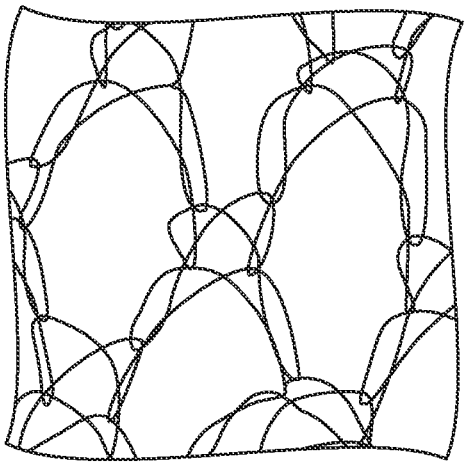
FIG. 8A is an embodiment of a knitted netting with an eight-stitch hex pattern.
Figure 8B:
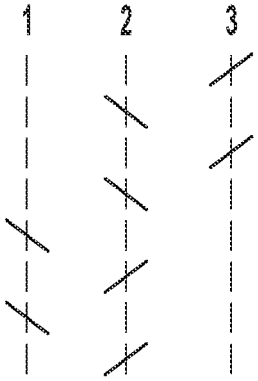
FIG. 8B is an exemplary embodiment of a knitting pattern for an eight-stitch hex pattern.

In one embodiment, the netting can be knitted into a "hex net" pattern. This pattern requires eight stitches to create one hex shape. The knitting pattern used to create the depicted hex net pattern is shown in FIG. 8B.

The elements of the figures are not exclusive. Other embodiments may be derived in accordance with the principles of the invention to accomplish the same objectives. Although this invention has been described with reference to particular embodiments, it is to be understood that the embodiments and variations shown and described herein are for illustration purposes only. Modifications to the current design may be implemented by those skilled in the art, without departing from the scope of the invention.

While various illustrative embodiments incorporating the principles of the present teachings have been disclosed, the present teachings are not limited to the disclosed embodiments. Instead, this application is intended to cover any variations, uses, or adaptations of the present teachings and use its general principles. Further, this application is intended to cover such departures from the present disclosure as come within known or customary practice in the art to which these teachings pertain.

In the above detailed description, reference is made to the accompanying drawings, which form a part hereof. The illustrative embodiments described in the present disclosure are not meant to be limiting. Other embodiments may be used, and other changes may be made, without departing from the spirit or scope of the subject matter presented herein. It will be readily understood that various features of the present disclosure, as generally described herein, and illustrated in the Figures, can be arranged, substituted, combined, separated, and designed in a wide variety of different configurations, all of which are explicitly contemplated herein.

The present disclosure is not to be limited in terms of the particular embodiments described in this application, which are intended as illustrations of various features. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. It is to be understood that this disclosure is not limited to particular methods or materials, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (for example, the term "including" should be interpreted as "including but not limited to," the term "having" should be interpreted as "having at least," the term "includes" should be interpreted as "includes but is not limited to," et cetera). While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

In addition, even if a specific number is explicitly recited, those skilled in the art will recognize that such recitation should be interpreted to mean at least the recited number (for example, the bare recitation of "two threads," without other modifiers, means at least two threads, or two or more threads). As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera. As a non-limiting example, each range discussed herein can be readily broken down into a lower third, middle third and upper third, et cetera. As will also be understood by one skilled in the art, all language such as "up to," "at least," and the like include the number recited and refer to ranges that can be subsequently broken down into subranges as discussed above. Finally, as will be understood by one skilled in the art, a range includes each individual member. Thus, for example, a group having 1-3 threads refers to groups having 1, 2, or 3 threads. Similarly, a group having 1-5 threads refers to groups having 1, 2, 3, 4, or 5 threads, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

The functions and process steps herein may be performed automatically or wholly or partially in response to user command. An activity (including a step) performed automatically is performed in response to one or more executable instructions or device operation without user direct initiation of the activity.

We claim:

1. A knitted net carrier comprising a netting comprising a plurality of strands of high tenacity polyester yarn knitted together in the form of a pattern, wherein the pattern is formed with one or more goblet shapes, wherein the netting is substantially in the shape of a tube having a length, a first end, and a second end, wherein the first end and the second end are fastened shut.

2. The knitted net carrier of claim 1, wherein each of the goblet shapes is formed using twenty stitches.

3. A knitted netting for making a knitted net carrier, the knitted netting comprising a netting comprising a plurality of strands of high tenacity polyester yarn knitted together in the form of a pattern, wherein the pattern is formed with one or more goblet shapes, wherein the netting is substantially in the shape of a tube having a length, a first end, and a second end.

4. The knitted netting of claim 3, wherein the high tenacity polyester yarn has a linear density of 500.

5. The knitted netting of claim 3, wherein the high tenacity polyester yarn has a tenacity of greater than 9.0 grams per density.

6. The knitted netting of claim 3, wherein the high tenacity polyester yarn has a 13.0 elongation at break.

7. The knitted netting of claim 3, wherein the high tenacity polyester yarn has a HAS of 6.5 at 15 min at 190° C.

8. The knitted netting of claim 3, wherein the high tenacity polyester yarn has an oil content of 0.55%.

9. The knitted netting of claim 3, wherein the netting's shininess is affected by the pattern's size and the number of threads used to knit the pattern.

10. The knitted netting of claim 3, wherein each of the goblet shapes is formed using twenty stitches.

11. The knitted net carrier of claim 1, wherein the high tenacity polyester yarn has a linear density of 500.

12. The knitted net carrier of claim 1, wherein the high tenacity polyester yarn has a tenacity of greater than 9.0 grams per density.

13. The knitted net carrier of claim 1, wherein the high tenacity polyester yarn has a 13.0 elongation at break.

14. The knitted net carrier of claim 1, wherein the high tenacity polyester yarn has a HAS of 6.5 at 15 min at 190° C.

15. The knitted net carrier of claim 1, wherein the high tenacity polyester yarn has an oil content of 0.55%.

16. The knitted net carrier of claim 1, wherein the netting's shininess is affected by the pattern's size and the number of threads used to knit the pattern.

* * * * *